US011247254B2

(12) United States Patent
Hopf

(10) Patent No.: US 11,247,254 B2
(45) Date of Patent: Feb. 15, 2022

(54) ADJUSTABLE DENT REMOVAL TOOL

(71) Applicant: Steven Hopf, Riverside, CA (US)

(72) Inventor: Steven Hopf, Riverside, CA (US)

( * ) Notice: Subject to any disclaimer, the term of this patent is extended or adjusted under 35 U.S.C. 154(b) by 421 days.

(21) Appl. No.: 16/286,351

(22) Filed: Feb. 26, 2019

(65) Prior Publication Data

US 2020/0269301 A1 Aug. 27, 2020

(51) Int. Cl.
*B21D 1/06* (2006.01)

(52) U.S. Cl.
CPC ..... *B21D 1/06* (2013.01)

(58) Field of Classification Search
CPC . B25G 1/00; B25G 1/06; B21D 37/06; B21D 1/06; B21D 1/08; B21D 1/10
USPC ..... 81/488, 489, 491, 177.1, 177.8, 177.9; 72/466.6, 479, 480
See application file for complete search history.

(56) References Cited

U.S. PATENT DOCUMENTS

| | | | |
|---|---|---|---|
| 751,345 | A | 2/1904 | Saunders |
| 4,480,511 | A | 10/1984 | Nickipuck |
| 4,692,073 | A | 9/1987 | Martindell |
| 4,768,405 | A | 9/1988 | Nickipuck |
| 4,781,085 | A | 10/1988 | Fox, III |
| 4,900,202 | A | 2/1990 | Wienhold |
| 5,013,194 | A | 5/1991 | Wienhold |
| 5,333,523 | A | 8/1994 | Palm |
| 5,398,946 | A | 3/1995 | Quiring |
| 5,779,404 | A | 7/1998 | Jore |
| 5,813,296 | A | 9/1998 | Hoff et al. |
| 5,873,289 | A | 2/1999 | Jarvis |
| 5,934,384 | A | 8/1999 | Wang |
| 6,176,654 | B1 | 1/2001 | Jore |
| 6,394,715 | B1 | 5/2002 | Boyle et al. |
| 6,533,291 | B2 | 3/2003 | Huggins et al. |
| 7,156,005 | B2 | 1/2007 | Cluthe |
| 9,868,143 | B2 | 1/2018 | Zimmerman |
| 9,999,912 | B2 * | 6/2018 | Schaechinger ..... B21J 13/02 |
| 2009/0056407 | A1 | 3/2009 | Greene |
| 2010/0000380 | A1 * | 1/2010 | Richardson ..... B25B 13/56 81/177.8 |

* cited by examiner

*Primary Examiner* — Gregory D Swiatocha

(57) ABSTRACT

An adjustable dent removal tool may include a handle coupled to a dual adjustment system, the dual adjustment system may include a body secured to the handle. The body may include a plurality of first engagement teeth. A piston may be provided that may be movably coupled to the body, the piston may include a plurality of second engagement teeth, which may be selectively engaged with the first engagement teeth, thereby releasably locking the body to the piston. A lower body may be secured to the body. The lower body may include a tool receiver. A tool shaft may be provided that may be releasably locked to the lower body in more than one position.

18 Claims, 5 Drawing Sheets

ADJUSTABLE DENT REMOVAL TOOL

FIELD OF THE INVENTION

The present invention generally relates to hand tools, more particularly, to tools used to remove dents from metal covers such as the body of a vehicle.

BACKGROUND OF THE INVENTION

Hand tools have been used throughout history. As machinery has increased in complexity, so has the need for tools that can more efficiently meet the needs of the worker with the tool in their hands. Dent removal tools are a special breed of tools as they may be used to remove dents from a sheet metal workpiece, such as anyplace on the body of a vehicle. The purpose of dent removal tools may be to remove dents without the need of repainting the workpiece after removing the dent. In contrast, a new part may be fabricated or a damaged part may be altered by aggressive removal of material or the addition of a filler to fill any depressions in the workpiece to give the appearance of a smooth part. After this type of work, the part must be painted to match the rest of the vehicle. This process is usually much more time consuming and costly as opposed to "working" a dent out by utilizing dent removal tools, which is usually faster and may not require repainting when finished.

The process of "working" out a dent may require a degree of skill as well as just applying a force to push the dent out. In many cases an extended tool with a tool tip may be used where the tool tip is what contacts the dent on the convex side of the dent. Force is applied to the tool, and thereby to the tool tip, sometimes in many small steps and from different angles and directions to work the dent out and finish with a flat and smooth finish on the workpiece. When an object hits a vehicle body, the dent may commonly be pressed from the outside of the vehicle in toward the inside of the vehicle. Therefore the convex portion of the dent may be hidden and obstructed by other parts of the vehicle body. As such, different tools with different configurations and lengths may be needed by the worker. Many traditional dent removal tools are of a welded construction so multiple tools may be needed by the worker to accomplish the task of removing the dent.

It should, therefore, be appreciated that there is a need for an adjustable dent removal tool in which the handle of the tool may be manipulated independently from a removable tool shaft, thereby making one handle assembly and multiple tool shafts functionally similar to a large number of individual dent removal tools. This may save time for the worker and save investment cost to the worker by providing one adjustable dent removal tool and eliminating the need to multiple independent dent removal tools.

SUMMARY OF THE INVENTION

The present invention may include a handle coupled to a dual adjustment system, the dual adjustment system may include a body secured to the handle. The body may include a plurality of first engagement teeth. A piston may be provide provided that may be movably coupled to the body, the piston may include a plurality of second engagement teeth. A piston spring may provide a bias of the piston toward the body such that the second engagement teeth of the body interlock with the first engagement teeth of the body.

A lower body may be secured to the body, the lower body may include a locking ball which may articulate with a ring, such that the ring holds the ball in a recessed position when the ring is in a first position and allows the ball to move to a retracted position when the ring is in a second position. The lower body may also include a tool receiver and a lower body spring supported by the lower body, the lower body spring providing a bias of the ring toward the first position. The tool may also include a tool shaft with a tool tip and an attachment end substantially opposite to the tool tip. The attachment end of the tool shaft may be received by the tool receiver of the lower body and releasably secured thereto when the locking ball is in the recessed position.

The adjustable dent removal tool may also include the lower body being secured to the body by way of a lower body screw. The lower body screw may be a threaded fastener. The attachment end of the tool shaft may include a ball groove that may receive a portion of the locking ball when the locking ball is in the recessed position. The locking ball may not contact the ball groove of the tool shaft when the locking ball is in the retracted position, thereby allowing the tool shaft to be inserted into, or removed from, the lower body.

The piston may be movably coupled to the body about a common axis, thereby the body may be displaced from the piston such that the first engagement teeth of the body are not engaged with the second engagement teeth of the piston and the body may be rotated with respect to the piston about the common axis. The displacement of the body from the piston may result in an increased compression of the piston spring while in this position. The tool receiver of the lower body may include one or more flat surfaces and the attachment end of the tool shaft also includes one or more flat surfaces, whereby when a flat surface of the tool receiver mates with a flat surface of the attachment end of the tool shaft, the combination provides a resistance to rotation of the tool shaft relative to the lower body.

The invention may also include a method of removing a dent including the structural elements are previously noted and includes the steps of moving the ring to allow the tool shaft to be placed in the lower body and locking it in a position by moving the ring so the locking ball is in the recessed position. Then positioning a portion of the tool shaft adjacent to a dent in a workpiece and applying force to the handle to manipulate the dent in the workpiece. Then applying force to the handle to disengage the first engagement teeth of the body from the second engagement teeth of the piston and rotating the handle, and therefore the body, relative to the piston and then allowing the first engagement teeth of the body to engage with the second engagement teeth of the piston, thereby locking the body to the piston. Then applying force to the handle to apply a modified force to the dent in the workpiece due to the change in the handle position relative to the tool shaft.

For purposes of summarizing the invention and the advantages achieved over the prior art, certain advantages of the invention have been described herein. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which:

FIG. 2 is an exploded view of the adjustable dent removal tool as presented in

FIG. 1.

DETAILED DESCRIPTION OF THE INVENTION

Figure 1:
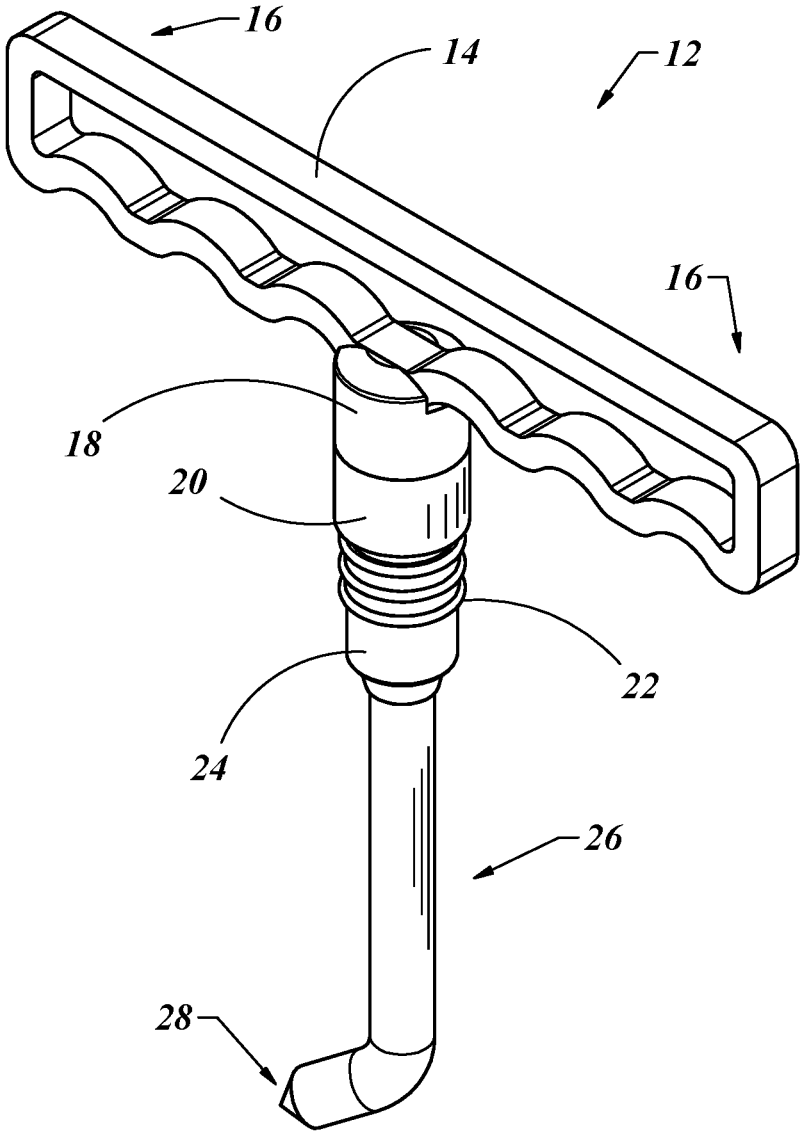
FIG. 1 is an isometric view of an adjustable dent removal tool in a fully assembled state.

With reference to the illustrative drawings and particularly to FIG. 1, there is shown an adjustable dent removal tool 12. The adjustable dent removal tool 12 may include a handle 14, which may have an extension 16 on one or both sides (as shown in FIG. 1) of a cap 18. The cap 18 may be securely coupled to the handle 14 by welding or otherwise fastened in some manner. The cap 18 may be securely coupled to a body 20. The cap 18 and the body 20 may be substantially cylindrical in shape and coupled together with a central axis of both the cap 18 and the body 20 positioned collinear to one another. In this manner, the combination of the cap 18 and the body 20 may provide a singular cylindrical structure that another cylindrical element may rotate about. A ring 22 may be positioned adjacent to the body 20 and a lower body 24 may provide a means for releasably receiving a tool shaft 26. The tool shaft 26 may include a tool tip 28, which may be used to contact a dent on a workpiece.

Figure 2:
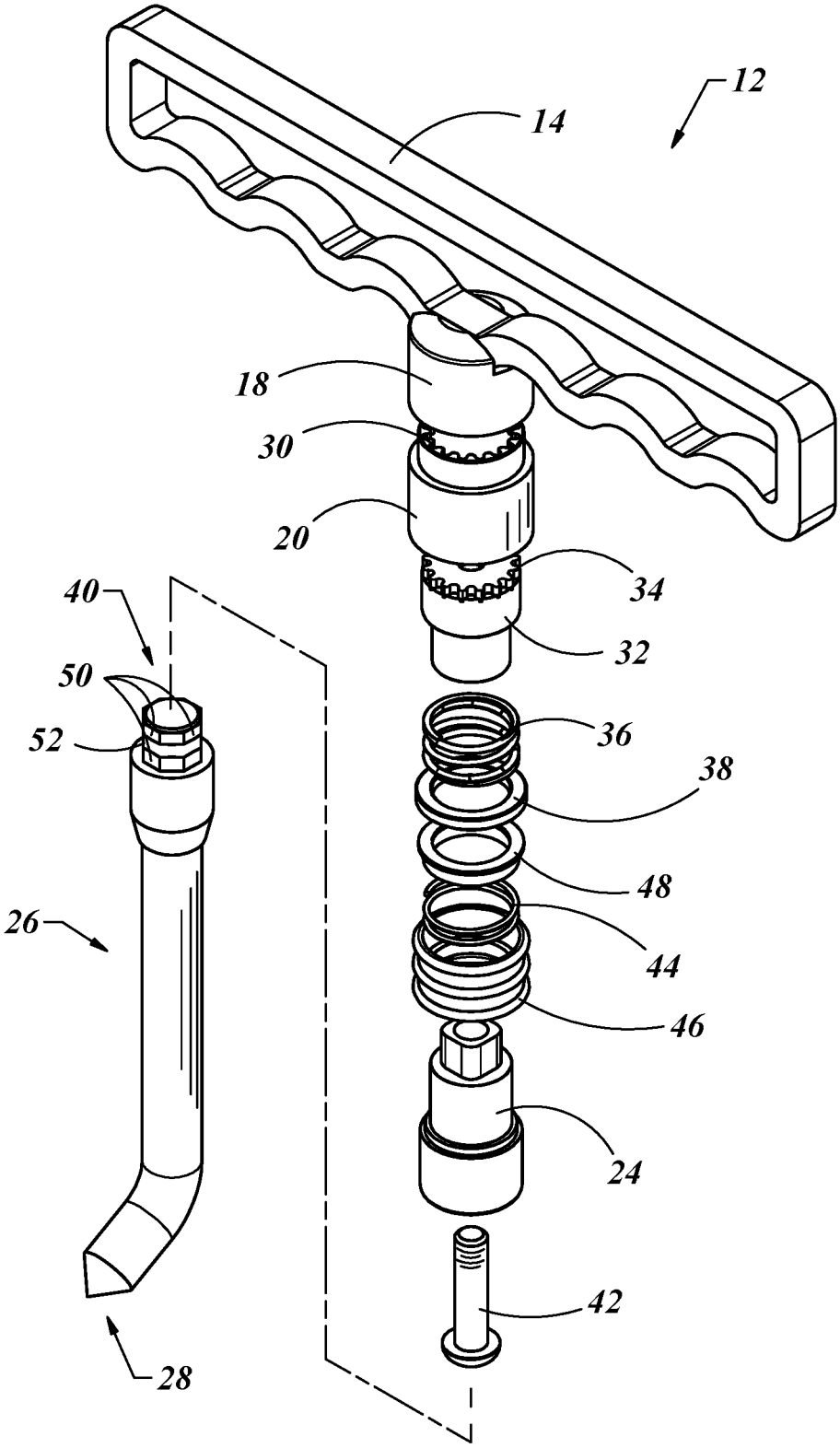

An exploded view of the adjustable dent removal tool 12 is shown in FIG. 2. In this view much of the additional detail of the assembly is shown. The body 20 may also include a plurality of first engagement teeth 30, which may be provided on an end of the body 20 nearest the cap 18. As previously mentioned, the body 20 and the cap 18 may be securely mounted to one another by welding or some other method.

A piston 32 may be provided that may be substantially cylindrical in shape and is capable of being received by the body 20, such that the piston 32 may be movably mounted to the body 20. The piston 32 may slidably move closer to the handle 14 or further away from the handle 14 when assembled. The piston 32 may also be free to rotate about a common central axis of the piston 32 and the body 20. To stop the free rotation of the piston 32 relative to the body 20, the piston 32 may include a plurality of second engagement teeth 34 to which the first engagement teeth 30 of the body 20 may interface with the second engagement teeth 34 of the piston 32 when the piston 32 is fully inserted into the body 20.

When the first engagement teeth 30 are interlocked with the second engagement teeth 34, the piston 32 may be functionally locked to the body 20, with regard to rotation. If the piston 32 is displaced a distance away from the handle 12, such that the first engagement teeth 30 are no longer contacting the second engagement teeth 34, the piston 32 may rotate freely with respect to the body 20 while the piston 32 is still substantially positioned within the body 20. The outer surface of the piston 32 may articulate with the inner surface of the body 20, thereby providing a bearing surface between the two parts to enable smooth rotation of the piston 32 relative to the body 20, and therefore the cap 18 and handle 14, when the first engagement teeth 30 are not in contact with the second engagement teeth 34. A piston spring 36 may be supported by a washer 38. The washer 38 may be press fit into the body 20 thereby capturing the piston 32 and the piston spring 36 within the body 20. The piston spring 36 may provide a bias of the piston 32 in the direction of the body 20, such that the relaxed position of the piston 32 relative to the body 20 is that the first engagement teeth 30 of the body 20 are engaged with the second engagement teeth 34 of the piston. This combination may comprise the first assembly of a dual adjustment system.

A second assembly of the dual adjustment system may include a tool shaft 26 with an attachment end 40 that is adapted to be received by the lower body 24. The lower body 24 may be coupled to the piston 32 by way of a lower body screw 42. A lower body spring 44 and a ring 46 may be received by a portion of the lower body 24. A spring washer 48 may be pressed onto a portion of the lower body 24 to cap off the second assembly of the dual adjustment system. The attachment end 40 of the tool shaft 26 may include one or more flat surfaces 50 and a ball groove 52. The details of how each of the first assembly of the dual adjustment system and the second assembly of the dual adjustment system are shown in more detail in the following figures.

Figure 4:
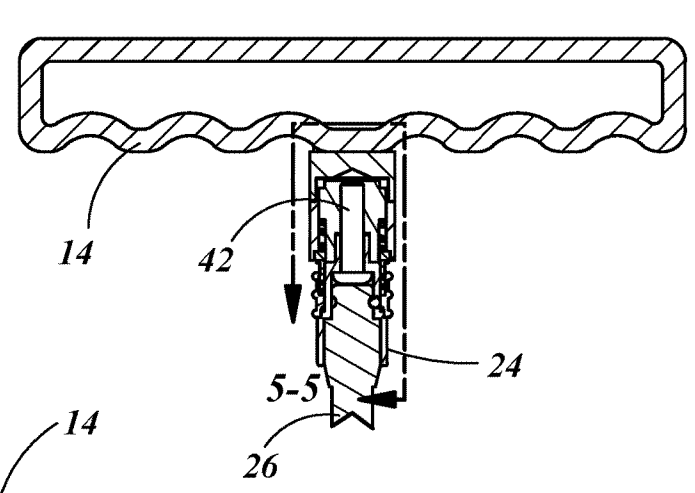
FIG. 4 is a sectioned view of the adjustable dent removal tool as presented in FIG. 3, cut along line 4-4.
Figure 5:
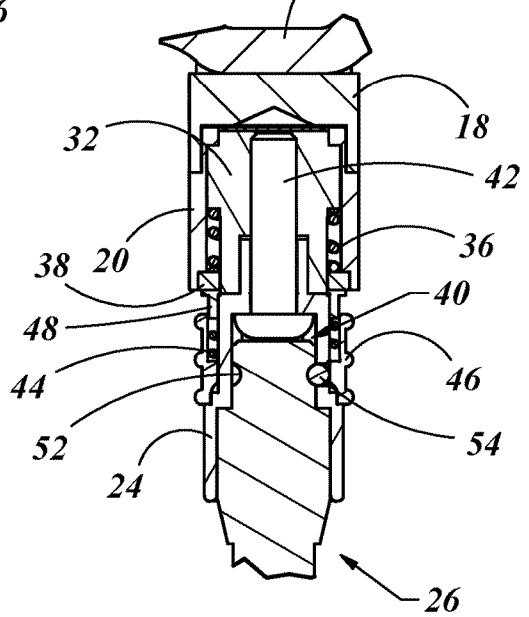
FIG. 5 is a detail view of the adjustable dent removal tool as presented in FIG. 4 cut along line 5-5.
Figure 3:
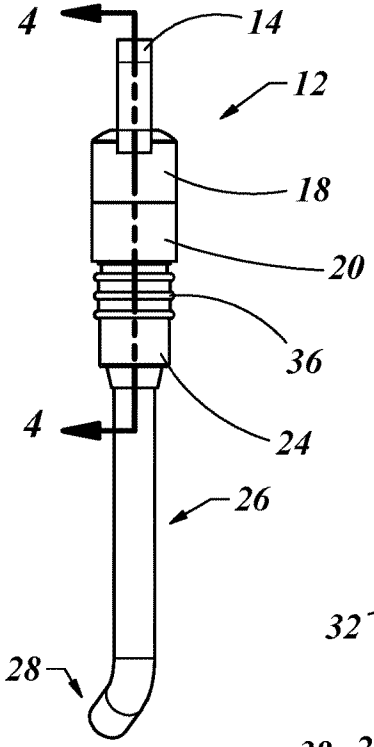
FIG. 3 is a side view of the adjustable dent removal tool as presented in FIG. 1.

With reference to FIGS. 3-5, an adjustable dent removal tool 12 is shown from a side view. This view includes a section line 4-4, in which the section view is shown in FIG. 4. The detail of this section view is shown more clearly in FIG. 5. These views show the adjustable dent removal tool 12 in an assembled state, as is illustrated in FIG. 1, with the attachment end 40 of the tool shaft 26 received in the lower body 24. What was not previously shown was that the tool shaft 26 may be releasably secured to the lower body 24 by way of a locking ball 54, which may be received by the ball groove 52 on the attachment end 40 of the tool shaft 26. The locking ball 54, when recessed by the current position of the ring 46, and received by the ball groove 52 of the tool shaft 26, prevents the tool shaft 26 from disengaging from the lower body 24. One or more of the flat surfaces 50 of the attachment end 40 of the tool shaft 26 may contact one or more flat surfaces on the inside of the lower body 24, thereby preventing the tool shaft 26 from rotating with respect to the lower body 24. By providing more than one flat surface 50 on the attachment end 40 of the tool shaft 26, and also on the inside of the lower body, the tool tip 28 of the tool shaft 26 may be positioned in more than one angular position relative to the lower body 24.

The number of flat surfaces 50 on the attachment end 40 and also on the lower body 24 may define how many positions the tool tip 28 may face relative to the lower body 24. For example, if there is only one flat surface 50, then when the tool shaft 26 can only be inserted into the lower body 24 in one position, so the tool tip 28 can only face one direction. If two flat surfaces 50 are provided, then the tool shaft 26 may be inserted in the lower body in two different positions, thus providing the tool tip 28 in two relative positions. The number of flat surfaces 50 is not critical to the novelty of the invention but the inventor has determined an optimal number of flat surfaces 50 to be eight, so that the tool tip 28 may be positioned in eight different positions relative to the lower body 24. This multi-positional location of the toll tip 28 relative to the lower body 24 may be considered are result of the second of the dual adjustment system.

Figure 7:
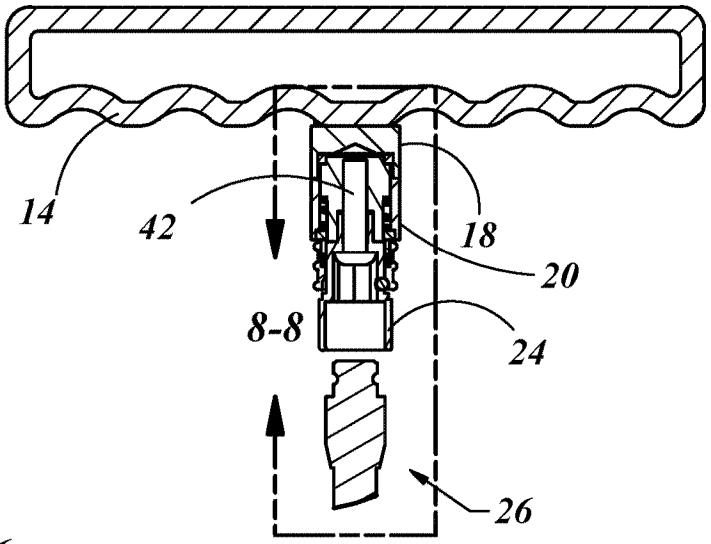
FIG. 7 is a sectioned view of the adjustable dent removal tool as presented in FIG. 6, cut along line 7-7.
Figure 8:
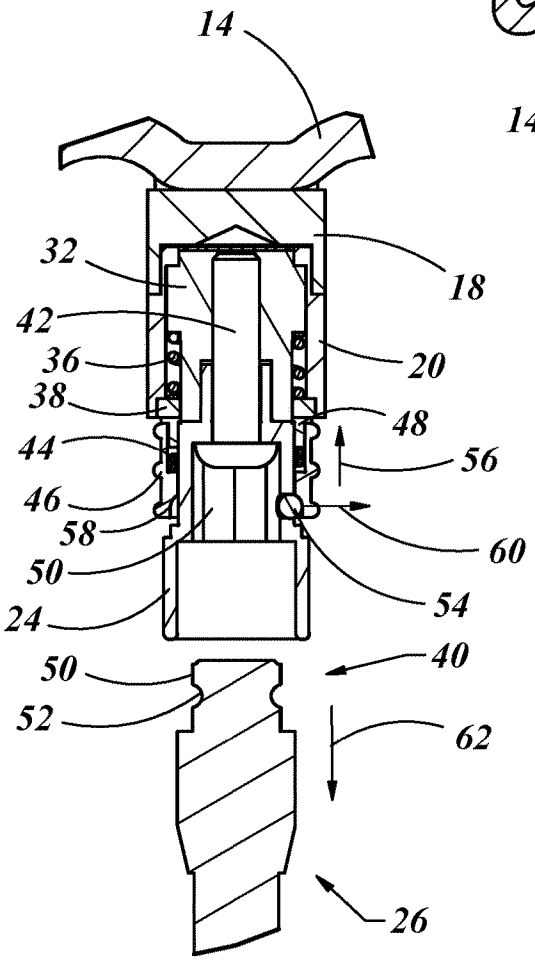
FIG. 8 is a detail view of the adjustable dent removal tool presented in FIG. 7 and cut along line 8-8.
Figure 6:
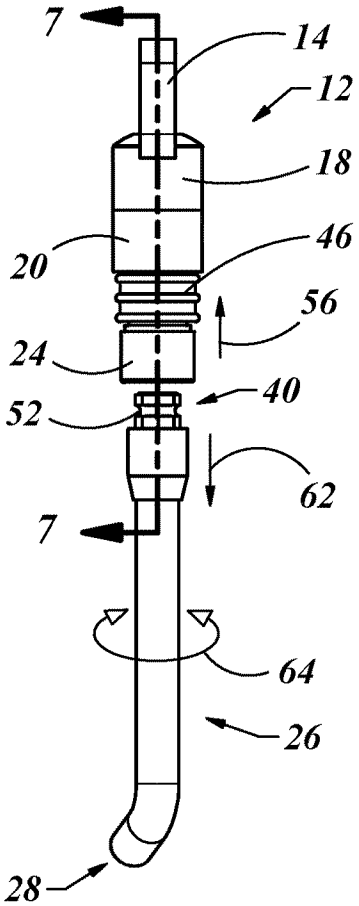
FIG. 6 is a side view of the adjustable dent removal tool as presented in FIG. 1, with the ring moved, the locking ball retracted and the tool shaft displaced from the lower body.

More detail of this second assembly of the duel adjustment system is shown in FIGS. 6-8, where the tool shaft 26 has been removed from the lower body 24. This may be accomplished by moving the ring 46 toward the handle 14, as illustrated by the first arrow 56. This may compress the lower body spring 44. A retraction groove 58 may be located in a lower portion of the ring 46, whereby the locking ball 54 may retract away from the tool shaft 26, as illustrated by the second arrow 60. This may release the locking ball 54 from the ball groove 52 in the attachment end 40 of the tool shaft 26, allowing the tool shaft 26 to be removed from the lower body 24 as indicated by the third arrow 62. At this point, if desired, the tool shaft 26 may be rotated so as to position the tool tip 28 in a different position relative to the lower body 24 and reinserted into the lower body 24 so that a flat surface 50 of the attachment end 40 of the tool shaft 26 is aligned with a flat surface 50 of the lower body 24. The ring 46 may then be released and the lower body spring 44 may position the ring 46 in its lower position, as previously shown. The movement of the ring 46 may cause the locking ball out of the retraction groove 58 and move inward toward the ball groove 52, as previously shown. This process may allow for the tool tip 28 of the tool shaft 26 to be moved to a different position relative to the lower body 24 as illustrated by the rotation arrow 64.

Figure 10:
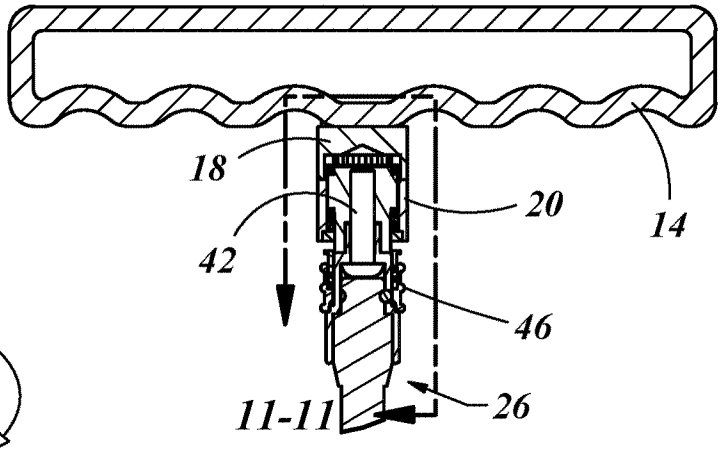
FIG. 10 is a sectioned view of the adjustable dent removal tool as presented in FIG. 9 and cut along line 10-10.
Figure 11:
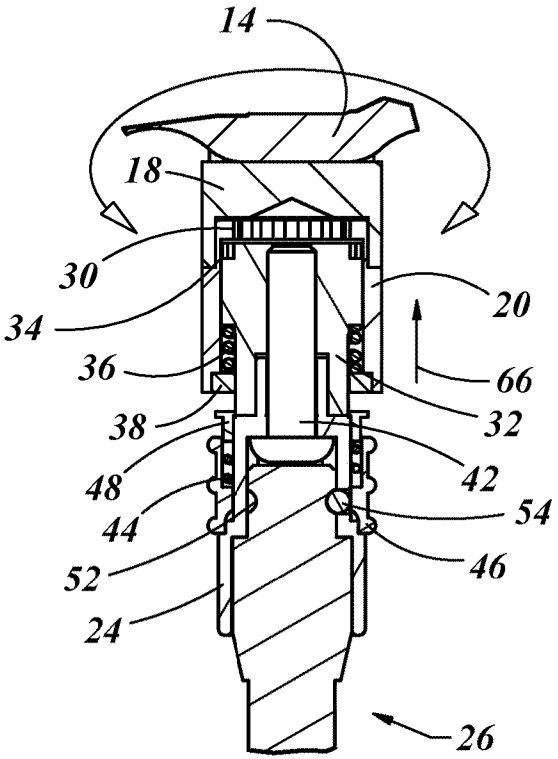
FIG. 11 is a detail view of the adjustable dent removal tool as presented in FIG. 10, cut along line 11-11.
Figure 9:
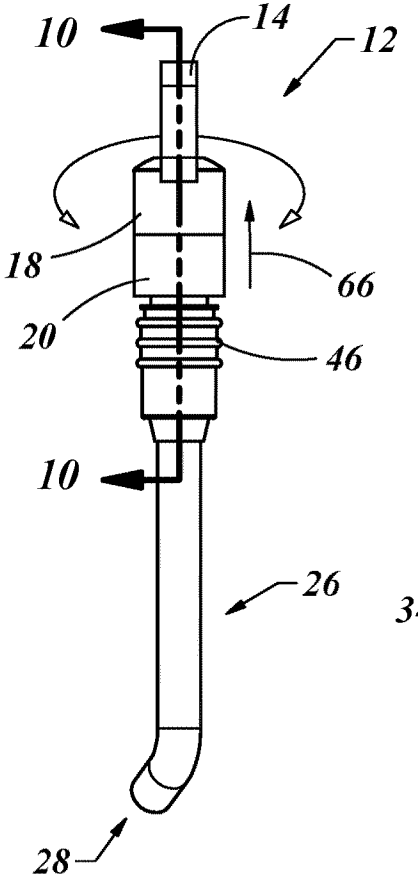
FIG. 9 is an adjustable dent removal tool as presented in FIG. 1, with the body displaced from the piston so as to allow positional adjustment of the handle relative to the lower body.

To move the tool tip 28 of the tool shaft 26 relative to the lower body 24, as previously described, may require the tool shaft 26 to be removed from the work area, meaning the entire adjustable dent removal tool 12 may be needed to be removed from the area of the vehicle or other device that is being worked on. This may take more time than desired by the worker if only a small adjustment in positioning of the tool tip 28 is what is needed. To solve that problem, the present invention may include an adjustment that may be provided by the first assembly of the duel adjustment system. This is further illustrated in FIGS. 9-11.

These figures show how the adjustable dent removal tool 12 may have the tool shaft 26 remain stationary with respect to the workpiece and the handle 14 may be rotated with respect to the tool tip 28. In this embodiment the handle 14 may be pulled away from the tool shaft 26, as illustrated by the fourth arrow 66. The movement of the handle 14, which will include the cap 18 and the body 20 due to the attachment to the handle as previously disclosed, may cause a compression of the piston spring 36 as the handle 14 is moved away from the piston 32. This may disengage the first engagement teeth 30 of the body 20 from the second engagement teeth 34 of the piston 32. This may allow the body 20 (and therefore the handle 12) to rotate about the piston 32. The user many then release tension on the handle 14, allowing the piston spring 36 to relax and push the second engagement teeth 34 of the piston 32 back into the first engagement teeth 30 of the body 20, thereby locking the body 20 (and therefore the handle 14) to the piston 32, as it applies to rotary movement of the piston 32 relative to the body 20. The result may be an angular adjustment of the handle 14 relative to the tool tip 28 without the need to remove the adjustable dent removal tool 12 from the workpiece.

This process saves time in that fewer steps are needed to make the adjustment using this, the first assembly of the dual adjustment system, as opposed to the second assembly of the dual adjustment system, as previously shown and described, where the tool shaft 26 is removed from the lower body 24. In addition, with this "handle only" adjustment, the tool tip 28 does not need to be relocated to the workpiece to find the dent in the workpiece, as it may if the entire tool shaft 26 were removed from the workpiece. As previously noted, in many cases the convex portion of the dent, where the force needs to be applied, is not visible from the worker's perspective. This may be a process that requires the worker to move and feel the adjustable dent removal tool 12 to locate it in the correct position that may not be necessary to move when only adjusting the position of the handle 14. The result of the combination of the adjustments, as presented herein, is increased functionality and adjustability with two adjustment capabilities that may be used by the worker at that time.

The foregoing detailed description of the present invention is provided for purpose of illustration, and it is not intended to be exhaustive or to limit the invention to the particular embodiment shown. The embodiments may provide different capabilities and benefits, depending on the configuration used to implement key features of the invention.

What is claimed is:

1. An adjustable dent removal tool, comprising:

a handle coupled to a dual adjustment system, the dual adjustment system including:

a body secured to the handle, the body including a plurality of first engagement teeth;

a piston movably coupled to the body, the piston including a plurality of second engagement teeth;

a piston spring providing a bias of the piston toward the body such that the second engagement teeth of the piston interlock with the first engagement teeth of the body;

a lower body secured to the body by way of a lower body screw, the lower body including a locking ball which articulates with a ring such that the ring holds the ball in a recessed position when the ring is in a first position and allows the ball to move to a retracted position when the ring is in a second position, the lower body also including a tool receiver;

a lower body spring supported by the lower body and providing a bias of the ring toward the first position; and a tool shaft with a tool tip and an attachment end, the attachment end of the tool shaft being received by the tool receiver of the lower body and releasably secured thereto when the locking ball is in the recessed position.

2. The adjustable dent removal tool according to claim 1, wherein the lower body screw is a threaded fastener.

3. The adjustable dent removal tool according to claim 1, wherein the attachment end of the tool shaft includes a ball groove that receives a portion of the locking ball when the locking ball is in the recessed position.

4. The adjustable dent removal tool according to claim 3, wherein the locking ball does not contact the ball groove of the tool shaft when the locking ball is in the retracted position, thereby allowing the tool shaft to be inserted into, or removed from, the lower body.

5. The adjustable dent removal tool according to claim 1, wherein the piston is movably coupled to the body about a common axis, thereby the body may be displaced from the piston such that the first engagement teeth of the body are not engaged with the second engagement teeth of the piston and the body may be rotated with respect to the piston about the common axis.

6. The adjustable dent removal tool according to claim 5, wherein the displacement of the body from the piston results in an increased compression of the piston spring.

7. The adjustable dent removal tool according to claim 1, wherein the tool receiver of the lower body includes at least one flat surface and the attachment end of the tool shaft also includes at least one flat surface, whereby when the at least one flat surface of the tool receiver mates with the at least one flat surface of the attachment end of the tool shaft, the combination provides a resistance to rotation of the tool shaft relative to the lower body.

8. The adjustable dent removal tool according to claim 7, wherein the at least one flat surface of the attachment end of the tool shaft and the at least one flat surface of the tool receiver of the lower body are both a plurality of flat surfaces.

9. An adjustable dent removal tool including a handle and a removable tool shaft, the adjustable dent removable tool comprising:

a body secured to the handle, the body including a plurality of first engagement teeth;

a piston movably coupled to the body, the piston including a plurality of second engagement teeth;

a piston spring providing a bias of the piston toward the body such that the second engagement teeth of the piston interlock with the first engagement teeth of the body;

a lower body secured to the body, the lower body including a locking ball which articulates with a ring such that the ring holds the ball in a recessed position when the ring is in a first position and allows the ball to move to a retracted position when the ring is in a second position, the lower body also including a tool receiver, wherein an attachment end of the tool shaft includes a ball groove that receives a portion of the locking ball when the locking ball is in the recessed position; and a lower body spring supported by the lower body and providing a bias of the ring toward the first position.

10. The adjustable dent removal tool according to claim 9, wherein the removable tool shaft includes a tool tip, the attachment end of the tool shaft being received by the tool receiver of the lower body and releasably secured thereto when the locking ball is in the recessed position.

11. The adjustable dent removal tool according to claim 9, wherein the, lower body is secured to the body by way of a lower body screw.

12. The adjustable dent removal tool according to claim 11, wherein the lower body screw is a threaded fastener.

13. The adjustable dent removal tool according to claim 9, wherein the locking ball does not contact the ball groove of the tool shaft when the locking ball is in the retracted position, thereby allowing the tool shaft to be inserted into, or removed from, the lower body.

14. The adjustable dent removal tool according to claim 9, wherein the piston is movably coupled to the body about a common axis, thereby the body may be displaced from the piston such that the first engagement teeth of the body are not engaged with the second engagement teeth of the piston and the body may be rotated with respect to the piston about the common axis.

15. The adjustable dent removal tool according to claim 14, wherein the displacement of the body from the piston results in an increased compression of the piston spring.

16. The adjustable dent removal tool according to claim 9, wherein the tool receiver of the lower body includes at least one flat surface and the attachment end of the tool shaft also includes at least one flat surface, whereby when the at least one flat surface of the tool receiver mates with the at least one flat surface of the attachment end of the tool shaft, the combination provides a resistance to rotation of the tool shaft relative to the lower body.

17. The adjustable dent removal tool according to claim 16, wherein the at least one flat surface of the attachment end of the tool shaft and the at least one flat surface of the tool receiver of the lower body are both a plurality of flat surfaces.

18. A method of removing a dent from a workpiece using a dent removal tool including a handle, a removable tool shaft, a body secured to the handle, the body including a plurality of first engagement teeth; a piston movably coupled to the body, the piston including a plurality of second engagement teeth; a piston spring providing a bias of the piston toward the body such that the second engagement teeth of the piston interlock with the first engagement teeth of the body; a lower body secured to the body by way of a lower body screw; the lower body including a locking ball which articulates with a ring such that the ring holds the ball in a recessed position when the ring is in a first position and allows the ball to move to a retracted position when the ring is in a second position, the lower body also including a tool receiver; and a lower body spring supported by the lower body and providing a bias of the ring toward the first position, the method including the steps of:

moving the ring to allow the tool shaft to be placed in the lower body, and locking it in a position by moving the ring so the locking ball is in the recessed position;

positioning a portion of the tool shaft adjacent to the dent in the workpiece;

applying force to the handle to manipulate the dent in the workpiece;

applying force to the handle to disengage the first engagement teeth of the body from the second engagement teeth of the piston;

rotating the handle and therefore the body relative to the piston;

allowing the first engagement teeth of the body to engage with the second engagement teeth of the piston, thereby locking the body to the piston;

applying force to the handle to apply a modified force to the dent in the workpiece due to the change in the handle position relative to the tool shaft.

* * * * *